US007348927B2

(12) United States Patent
Mondadori et al.

(10) Patent No.: US 7,348,927 B2
(45) Date of Patent: Mar. 25, 2008

(54) SERIGRAPHED ANTENNA FOR THE REAR WINDOW OF A SALOON-TYPE CAR

(75) Inventors: Alessandro Mondadori, Poissy (FR); Didier Viratelle, Voisins-le-Bretonneux (FR)

(73) Assignee: Societe de Composants Electriques (FR)

( * ) Notice: Subject to any disclaimer, the term of this patent is extended or adjusted under 35 U.S.C. 154(b) by 35 days.

(21) Appl. No.: 10/586,919

(22) PCT Filed: Feb. 7, 2005

(86) PCT No.: PCT/FR2005/000268

§ 371 (c)(1),
(2), (4) Date: Jul. 24, 2006

(87) PCT Pub. No.: WO2005/078857

PCT Pub. Date: Aug. 25, 2005

(65) Prior Publication Data

US 2007/0120754 A1 May 31, 2007

(30) Foreign Application Priority Data

Feb. 6, 2004 (FR) ..... 04 01140

(51) Int. Cl.
*H01Q 1/32* (2006.01)

(52) U.S. Cl. ..... 343/713; 343/704

(58) Field of Classification Search ..... 343/713, 343/711, 704
See application file for complete search history.

(56) References Cited

U.S. PATENT DOCUMENTS

| | | | | |
|---|---|---|---|---|
| 5,266,960 | A | 11/1993 | Lindenmeier et al. | |
| 5,659,324 | A * | 8/1997 | Taniguchi et al. | 343/713 |
| 5,831,580 | A * | 11/1998 | Taniguchi et al. | 343/713 |
| 6,498,588 | B1 | 12/2002 | Callaghan | |
| 2002/0171600 | A1 | 11/2002 | Lindenmeier et al. | |

FOREIGN PATENT DOCUMENTS

| | | |
|---|---|---|
| WO | WO 00/07078 | 11/2000 |

* cited by examiner

*Primary Examiner*—Hoang V. Nguyen
(74) *Attorney, Agent, or Firm*—Gerald Hespos; Anthony J. Casella

(57) ABSTRACT

The aerial of antennas FM1 and FM2 comprises, in addition to the original defrosting network (2), two pairs of vertical lines (9,10) which are disposed symmetrically in relation to the median vertical longitudinal plane of the vehicle. The FM1 signal is collected at a point (12) of the aerial which makes it possible to obtain a directive signal in the direction of the length of the vehicle on a plane with zero height. The FM2 signal is collected at a point (13) which is different from the aerial, making it possible to obtain a directive signal in the direction of the width of the vehicle on a plane with zero height. The serigraphed antenna for the rear window of a salon-type car provides excellent reception for FM, AM and servitude function modes.

9 Claims, 1 Drawing Sheet

SERIGRAPHED ANTENNA FOR THE REAR WINDOW OF A SALOON-TYPE CAR

Figure 1:
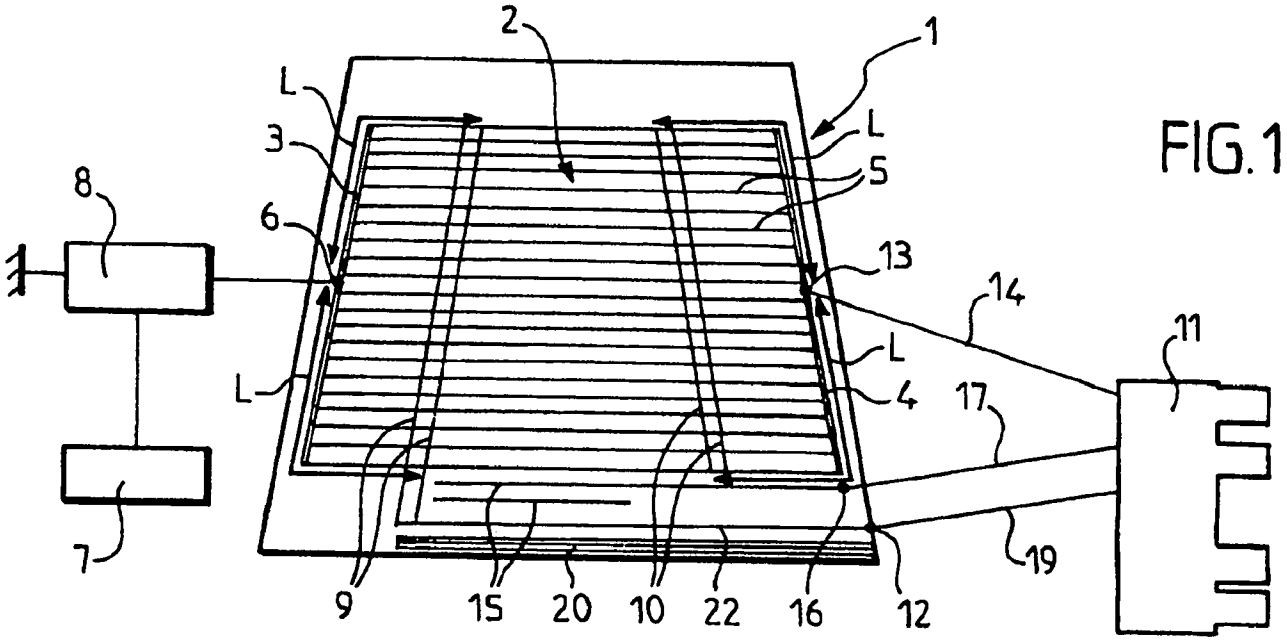

This application is a 371 of PCT/FR05/00268 dated Feb. 7, 2005.

The present invention relates to antennas used on motor vehicles, more particularly antennas screen printed on the rear window of such vehicles and especially saloon type motor vehicles.

The antennas intended to be fitted onboard touring or commercial vehicles are increasingly integrated so that they are no longer visible from outside the vehicle, so affording the latter a more harmonious appearance, in line with the current tastes of the public. The drawbacks associated with the use of projecting equipment, which relate to aerodynamics, noise, vibration, seal tightness and vandalism, are thus strongly reduced.

It is important for the antenna to be placed in an environment such that it can continue to provide its essential function which consists in transducing an electromagnetic field (outside the vehicle) into an electrical signal that can be used by a radio device.

A trade-off therefore always has to be found, between the position of the antenna that is required to be as little visible as possible and its radiation performance characteristics that are affected all the more so when the radiative structure of the antenna is incorporated in the vehicle and in particular close to its metallic parts.

On the other hand, motor vehicle manufacturers are strongly interested in a single, so-called "multifunction" box, comprising a number of functions, which makes it possible to simplify integration into the vehicle and the running of the cables linking this box to the car radio reception device or to the device that requires signals received by the antenna.

The FM and REMOTE KEYLESS ENTRY antennas are terrestrial linear polarization antennas and the reference is an antenna of length equal to a quarter of the wavelength (or a length of approximately 750 mm for FM and 170 mm for REMOTE KEYLESS ENTRY).

The current state of the art offers numerous options for so-called concealed antennas, in particular for the following three radio reception functions:

- FM (frequency modulation) radio between 76 MHz and 108 MHz;
- AM (amplitude modulation) radio between 140 kHz and 1.7 MHz;
- REMOTE KEYLESS ENTRY function, 434 MHz (or 315 MHz for Japan).

The radiative part of these antennas is made up of conductive lines screen printed on the glazed part of the vehicle which is then used as a support. The lines have a thickness of 0.8 mm supporting a current that is sufficient and acceptable for the de-icing function to work correctly.

For a saloon type vehicle, the rear window is used as a support for the multi-antenna system. The rear window needs to be made typically of extruded type glass with no athermic treatment applied.

In general, each of the functions of concealed FM, AM and REMOTE KEYLESS ENTRY antennas uses an aerial and an electronic circuit as near as possible to the latter.

- The aerial of the AM antenna is formed by one or more horizontal conductive lines approximately 0.8 mm thick in the top or bottom part of the rear window.

These screen printed lines are not involved in the de-icing function. The electronic box comprises an electronic circuit providing a high impedance matching of the aerial to the radio receiver.

- The aerial of the FM antenna is made up of a number of horizontal conductive lines varying between a minimum of 15 and a maximum of 25. These lines, approximately 0.8 mm thick, are also involved in the de-icing function. The electronic box comprises a circuit providing the impedance matching of the aerial to the characteristic impedance of the coaxial cable outgoing from the box, that is, equal to a value as close as possible to 75 ohms.
- The aerial of the REMOTE KEYLESS ENTRY antenna can be the same as the AM aerial or the FM aerial. The electronic box comprises an electronic board handling the impedance matching of the aerial to the impedance of the coaxial cable outgoing from the box, that is, close to 50 ohms.

This box is said to be passive or active depending on whether a +12 V power supply is used originating directly or indirectly from the battery of the vehicle. The function of the active box is to boost the signal with the use of one or more transistors. The decision to use an active or passive electronic box is made according to the average gain calculated relative to a reference antenna (quarter-wave antenna).

Normally, the minimum gain that is acceptable relative to the reference antenna is around −10 dB. The average gain is obtained by calculating the average of the 360 measurement values (one measurement at each degree around the vehicle). If, with a passive box, the antenna is below this limit of −10 dB, there is normally a switch to an active box to offset the dB shortfall.

In high end vehicles, FM reception is enhanced by combining different antennas, for example up to four antennas, called FM1, FM2, FM3 and FM4. These different antennas use the same support of the rear window and are differentiated by their collector point. These collector points on the rear window then create four different electromagnetic responses. These different antennas can then be combined (signals added or subtracted or switched in rotation) in order to supply an output signal that is enhanced in comparison to a single screen printed antenna.

This system of antennas is in particular intended for target vehicles from motor manufacturers having a rear window of conventional design, made of extruded glass with no athermic treatment applied.

The object of the present invention is to propose a screen printed antenna device for the rear window of a saloon type motor vehicle, of the general known type mentioned above and which, while providing excellent reception of the signals both in frequency modulation and amplitude modulation modes and in the remote keyless entry function, is particularly simple and economical to design and fit.

The antenna screen printed on a rear window of a saloon type motor vehicle according to the invention has four radio reception functions, namely AM, FM1, FM2 and REMOTE KEYLESS ENTRY, and comprises:

- an AM antenna with an aerial made up of at least one horizontal conductive line located in the top or bottom part of the rear window and not involved in the de-icing function, the aerial of the AM antenna being associated with a first electronic circuit located in an electronic box and providing a high impedance matching of said aerial to a radio receiver;
- FM1 and FM2 antennas having one and the same aerial made up of a number of horizontal conductive lines that are involved in the de-icing function, these two antennas having different signal collector points (12, 13) and each comprising a circuit of the electronic box providing the impedance matching of their aerial to the characteristic impedance of the coaxial cable outgoing from the electronic box; and a REMOTE KEYLESS ENTRY antenna having the same aerial as that of the AM antenna, a circuit of the electronic box providing impedance matching of the aerial of this antenna to the impedance of the coaxial cable outgoing from the box.

It is characterized in that the aerial of the FM1 and FM2 antennas comprises, in addition to the original de-icing network, two pairs of vertical lines disposed symmetrically relative to the median vertical longitudinal plane of the vehicle, the FM1 signal being collected at a point of the aerial so as to obtain a directional signal in the lengthwise direction of the vehicle in a plane of zero height, and the FM2 signal being collected at a different point of the aerial so as to obtain a directional signal in the widthwise direction of the vehicle in a plane of zero height.

According to a particular characteristic of the invention, each pair of vertical lines of the aerial of the FM1 and FM2 antennas is placed approximately 510 mm from the mid-point of the corresponding de-icing collector.

According to other characteristics of the invention:

the electronic circuit of the FM1 antenna is a passive circuit whereas the electronic circuit of the FM2 antenna is an active circuit; and the electronic circuit of the AM antenna is an active circuit, and the electronic circuit of the REMOTE KEYLESS ENTRY antenna is a passive circuit.

According to yet another characteristic of the invention, the electronic box is made up of a single board comprising the four electronic circuits of the FM1, FM2, AM and REMOTE KEYLESS ENTRY antennas, the collector points of the signals on the aerials of these antennas being grouped in the same sector of the rear window of the vehicle to make the length of the connecting wires from the rear window to said box as short as possible.

Figure 2:
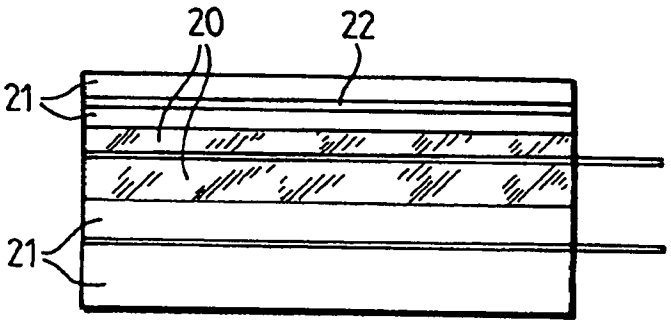

To give a good understanding of the invention, there follows, as a by no means limiting example, a description of a preferred embodiment with reference to the appended schematic drawing in which:

FIG. 1 is a front view of a rear window of a saloon type motor vehicle equipped with a screen printed antenna system according to the present invention; and FIG. 2 is a larger scale representation of the bottom part of the screen printed antenna of FIG. 1.

In FIG. 1, the reference 1 denotes the rear window of a saloon type motor vehicle, which is slightly trapezoidal in form, and has a surface area of less than 0.7 $m^2$. The window 1 has screen printed on it a de-icing network 2 conventionally comprising two collectors 3, 4 interlinked by horizontal wires 5. The collector 3 is linked at its mid-point 6 to the power supply battery 7 of the vehicle via a filter 8.

A first FM1 frequency modulation antenna comprises an aerial made up of the original de-icing network 2 to which are added two pairs of vertical lines 9, 10 which are symmetrical relative to the median vertical longitudinal plane of the window 1. An electronic box 11 matches the impedance of the FM1 antenna to 75 ohms. The FM1 signal is collected on the screen print of the FM1 antenna at a point 12 so as to obtain a directional antenna in the direction of the X axis (longitudinal axis of the vehicle), on the plane Z=o (plane of zero height).

A second FM2 frequency modulation antenna comprises the same aerial as that of the FM1 antenna and an active electronic box. The FM2 signal is not collected at the same point as the FM1 signal, but at a point 13 located at the mid-point of the de-icing collector 4, this point 13 being chosen so as to obtain a directional FM2 signal in the direction of the Y axis (transverse axis of the vehicle), on the plane Z=o. The FM2 signal collected at 13 is transmitted to the electronic box 11 which matches the FM2 antenna to 75 ohms and boosts the signal. The point 13 is disposed on the collector 4 which is located on the same side as the box 11, such that the link between this point 13 and the box 11 is via a single wire 14 of approximately 300 mm.

A third AM amplitude modulation antenna is made up of an AM aerial and an active impedance matching box. The AM aerial is made up of horizontal lines 15 screen printed in the bottom part of the window 1, the collector point of the signal being at 16.

A fourth REMOTE KEYLESS ENTRY antenna is made up of a REMOTE KEYLESS ENTRY aerial and a passive impedance matching box. The REMOTE KEYLESS ENTRY aerial comprises, like the AM aerial, screen printed horizontal lines 15, the collector point of the signal also being at 16.

As indicated above, a filter 8 is interposed between the power supply battery 7 and the mid-point 6 of the de-icing collector 3. This filter 8, which comprises an inductive element and a smoothing capacitive element connected to the chassis of the vehicle, ensures correct operation of the system of antennas, preventing the radio frequency signal from being conducted, via the de-icing power supply wires, to the battery 7.

The electronic box 11 comprises a single electronic board with four circuits, namely:

a circuit for the AM function, which is linked to the point 16 by a connecting wire 17;

a circuit for the FM1 function, which is linked to the point 12 of the FM1 aerial by a connecting wire 19;

a circuit for the FM2 function, which is linked to the point 13 of the FM2 aerial by the wire 14; and a circuit for the REMOTE KEYLESS ENTRY function, which is linked to the point 16 by the connecting wire 17, like the circuit for the AM function.

The wires 14, 17 and 19 are designed to be as short as possible, that is no longer than 300 mm, to avoid losses in FM and AM modes.

The electronic box 11 is advantageously disposed near to the bottom part of the rear window of the vehicle, on the right or on the left. This box 11 is rectangular in shape and is preferably disposed on the metallic rear plate or on the metallic strut adjacent to the rear window. It is fixed by a screw to the chassis, the latter then being used to obtain the ground signal.

As can be seen more particularly in FIG. 2, a thick screen printed ground line 20, with a thickness for example of approximately 15 mm, is in contact with the glue 21 fixing the rear window 1 to the chassis. This ground line 20 and a screen printed line 22 in the bottom part of the window form a transmission line for the FM1 radio frequency signal. The FM1 signal is thus transmitted from the side of the electronic box 11, such that a single wire 19 (approximately 150 mm long) takes the signal at the point 12 and directs it to the box 11. Alongside the point 12 there is the collector point 16 which extracts the AM and REMOTE KEYLESS ENTRY signals by means of a single wire of approximately 150 mm going to the box 11.

Advantageously, the pairs of vertical lines 9 and 10 are respectively placed at a distance L of approximately 510 mm (a quarter of the wavelength) from the mid-points 6, 13 of the de-icing collectors (see FIG. 1), so as to obtain an antenna system, resonant in the FM band, presenting the maximum radiated energy in this band.

It will be understood that the above description has been given simply as an example, by no means limiting, and that constructive additions or modifications could be made without departing from the scope of the present invention.

The invention claimed is:

1. An antenna screen printed on a window located at the rear of a saloon type motor vehicle and comprising a de-icing network (2) consisting of two collectors (3, 4) interlinked by a number of horizontal conductive lines (5), the antenna providing four radio reception functions, namely AM, FM1, FM2 and REMOTE KEYLESS ENTRY, and comprising:

an AM antenna with an aerial made up of at least one horizontal conductive line (15) located in one of the top and bottom parts of the rear window and not included in the de-icing network (2), the aerial of the AM antenna being associated with a first electronic circuit located in an electronic box (11) and providing a high impedance matching of said aerial to a radio receiver;

FM1 and FM2 antennas having a common aerial made up of the de-icing network (2) and vertical lines (9, 10) and having different signal collector points (12, 13) that are used to obtain directional signals respectively in first and second directions in a plane of zero height, each antenna having a circuit located in the electronic box (11) and providing impedance matching of their aerial to the characteristic impedance of the coaxial cable outgoing from the electronic box, and a REMOTE KEYLESS ENTRY antenna comprising an aerial and a circuit located in the electronic box (11) and providing impedance matching of its aerial to the impedance of the coaxial cable outgoing from the box, characterized in that:

the vertical lines (9, 10) comprise two pairs of vertical lines disposed symmetrically relative to the median vertical longitudinal plane of the vehicle;

the signals supplied by the FM1 and FM2 antennas are respectively directional in the lengthwise direction of the vehicle and in the widthwise direction of the vehicle;

the aerial of the REMOTE KEYLESS ENTRY antenna is the aerial of the AM antenna the signal collector point (12) of the aerial of the FM1 antenna is located on a screen printed line (22) located in the bottom part of the rear window, alongside the electronic box (11);

the signal collector point (13) of the aerial of the FM2 antenna is located at the mid-point of the collector (4), disposed on the side of the electronic box, of the de-icing network (2); and the signal collector points (12, 13) are linked to the electronic box by connecting wires (19, 14).

2. The screen printed antenna of claim 1, characterized in that each pair (9, 10) of vertical lines is placed approximately 510 mm from the mid-point (6 or 13) of the corresponding de-icing collector (3 or 4).

3. The screen printed antenna of claim 1, characterized in that the electronic circuit of the FM1 antenna is a passive circuit whereas the electronic circuit of the FM2 antenna is an active circuit.

4. The screen printed antenna of claim 1, characterized in that the electronic circuit of the AM antenna is an active circuit, and the electronic circuit of the REMOTE KEYLESS ENTRY antenna is a passive circuit.

5. The screen printed antenna of claim 1, characterized in that the electronic box (11) is made up of a single board comprising the four electronic circuits of the FM1, FM2, AM and REMOTE KEYLESS ENTRY antennas, the collector points (12, 13, 16) of the signals on the aerials of these antennas being grouped in the same sector of the rear window of the vehicle to make the length of the connecting wires (19, 14, 17) from the rear window (1) to the box (11) as short as possible.

6. The screen printed antenna of claim 5, characterized in that the electronic box (11) is fixed to the right or left strut of the vehicle, towards the bottom of the rear window (1).

7. The screen printed antenna of claim 1, characterized in that it comprises a transmission line for the FM1 signal, made up of a thick screen printed ground line (20) and the screen printed line (22) linked to the FM1 aerial (9) to bring the FM1 signal from one corner to the opposite corner of the rear window (1).

8. The screen printed antenna of claim 1, characterized in that the aerial of the AM and REMOTE KEYLESS ENTRY antennas is made up of two horizontal screen printed lines (15) in the bottom part of the rear window (1).

9. The screen printed antenna claim 1, characterized in that a filtering system (8) is placed between the electrical power supply battery (7) and the de-icing network (2), this filtering system being made up of a capacitive element and an inductive element in series.

* * * * *